US005301521A

United States Patent [19]

Bertoldo

[11] Patent Number: 5,301,521

[45] Date of Patent: Apr. 12, 1994

[54] APPARATUS FOR CONTINUOUSLY DECATIZING A FABRIC

[75] Inventor: Franco Bertoldo, Brogliano, Italy

[73] Assignee: Sperotto Rimar S.p.A., Thiene, Italy

[21] Appl. No.: 946,625

[22] Filed: Sep. 18, 1992

[30] Foreign Application Priority Data

Sep. 19, 1991 [IT] Italy ..... M191 A 002478

[51] Int. Cl.[5] ..... D06B 5/08

[52] U.S. Cl. ..... 68/5 D; 68/5 E; 68/903; 34/123

[58] Field of Search ..... 8/149.3; 68/5 R, 5 B, 68/5 D, 5 E, 8, 903; 34/123

[56] References Cited

U.S. PATENT DOCUMENTS 3,822,485 7/1974 Bates ..... 34/121
4,556,450 12/1985 Chuang et al. ..... 34/123 X
4,858,448 8/1989 Vecchia ..... 68/5 E

FOREIGN PATENT DOCUMENTS 1635329 4/1971 Fed. Rep. of Germany .
3316127 11/1984 Fed. Rep. of Germany .
1518905 7/1978 United Kingdom .
2234535 2/1991 United Kingdom .

*Primary Examiner*—Philip R. Coe
*Attorney, Agent, or Firm*—Cushman, Darby & Cushman

[57] ABSTRACT

An apparatus for continuous fabric decatizing, comprising a cylindrical drum, the outer lateral surface of which is covered with a sleeve of textile material about which the fabric is fed, the cylindrical drum and the sleeve being at least partially covered and embraced externally by an endless under-piece of textile material arranged so that at least one portion of the under-piece maintains the fabric in contact with the sleeve, the rotary drum being perforated and supported on a fixed coaxial inner cylinder having a diameter less than the drum and being maintained spaced therefrom by radial wall extensions which are positioned within the portion of the lateral surface of the drum in which the fabric is maintained in contact with the sleeve, and are connected together to define a chamber containing an atmosphere of steam under pressure fed from the outside of the fixed cylinder, and a subsequent forced suction treatment chamber.

12 Claims, 4 Drawing Sheets

APPARATUS FOR CONTINUOUSLY DECATIZING A FABRIC

BACKGROUND OF THE INVENTION

The present invention relates to an apparatus for continuous fabric decatizing.

European patent EP-A-293028 describes a method for continuous fabric decatizing and the respective apparatus, in which the fabric is continuously fed to a zone in an environment of saturated steam under pressure, this zone being sealed towards the outside, and the fabric being maintained within this zone between at least one under-piece of textile material and a cylindrical drum covered with textile material.

That prior art method and the respective apparatus are not, however free of drawbacks and operational limitations. In particular, because the decatizing process comprises overall a fabric cooling stage following its steaming stage, the apparatus of that prior patent has to include a known fabric cooling device for this purpose. This device consists, for example of a perforated cylindrical suction drum of considerable overall size and plant complexity, representing a substantial investment and operating cost.

SUMMARY OF THE INVENTION

The object of the present invention is to provide an apparatus for continuous fabric decatizing, in which the fabric cooling stage following its steaming stage can be implemented without any constructional or operational complication.

BRIEF DESCRIPTION OF THE DRAWINGS

Constructional and operational characteristics and advantages of a continuous fabric decatizing apparatus according to the present invention will be more apparent from the description given hereinafter by way of non-limiting example with reference to the accompanying schematic drawings, in which.

DETAILED DESCRIPTION

Figure 1:
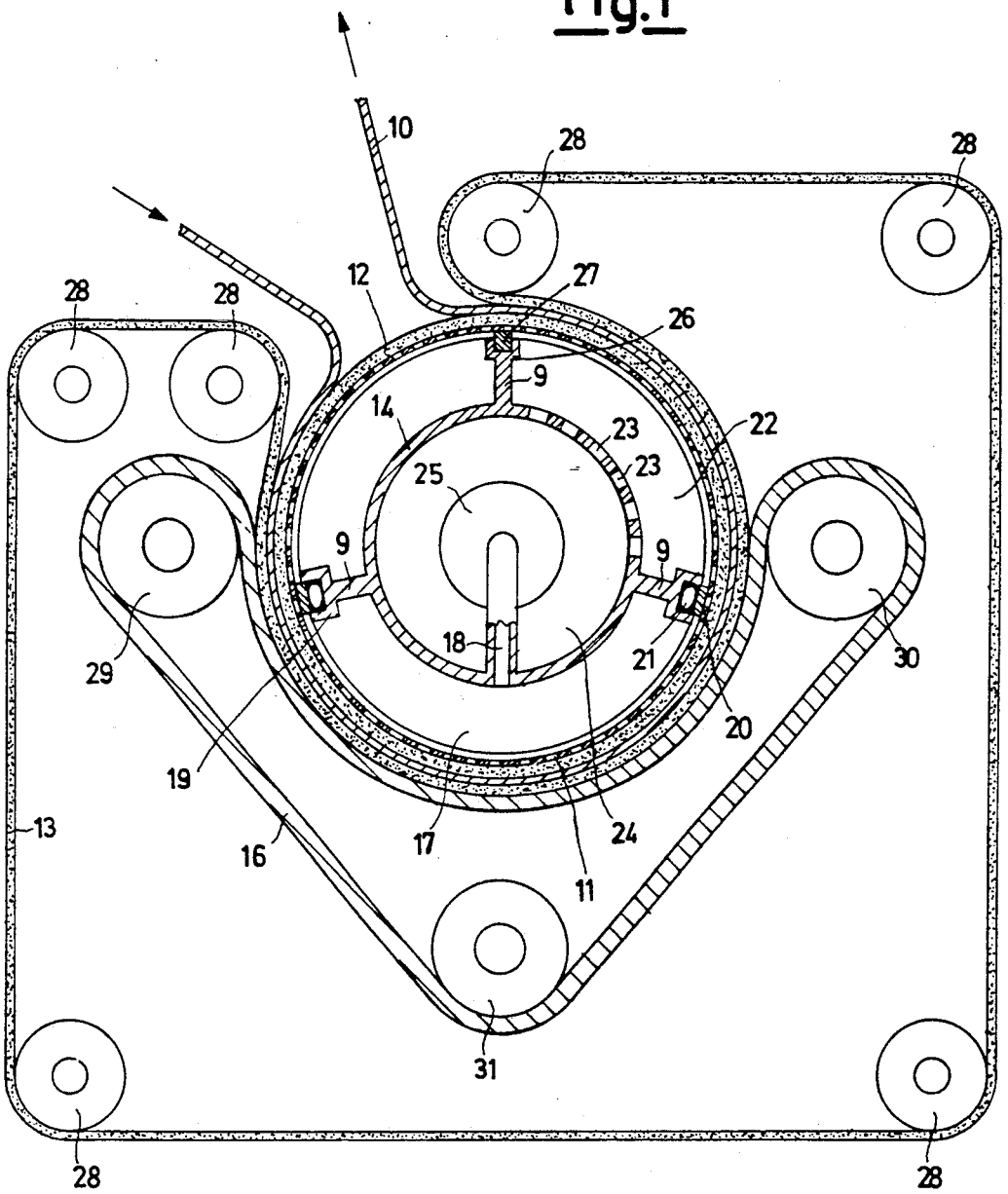
FIG. 1 is a cross-section through an apparatus according to the invention.
Figure 2:
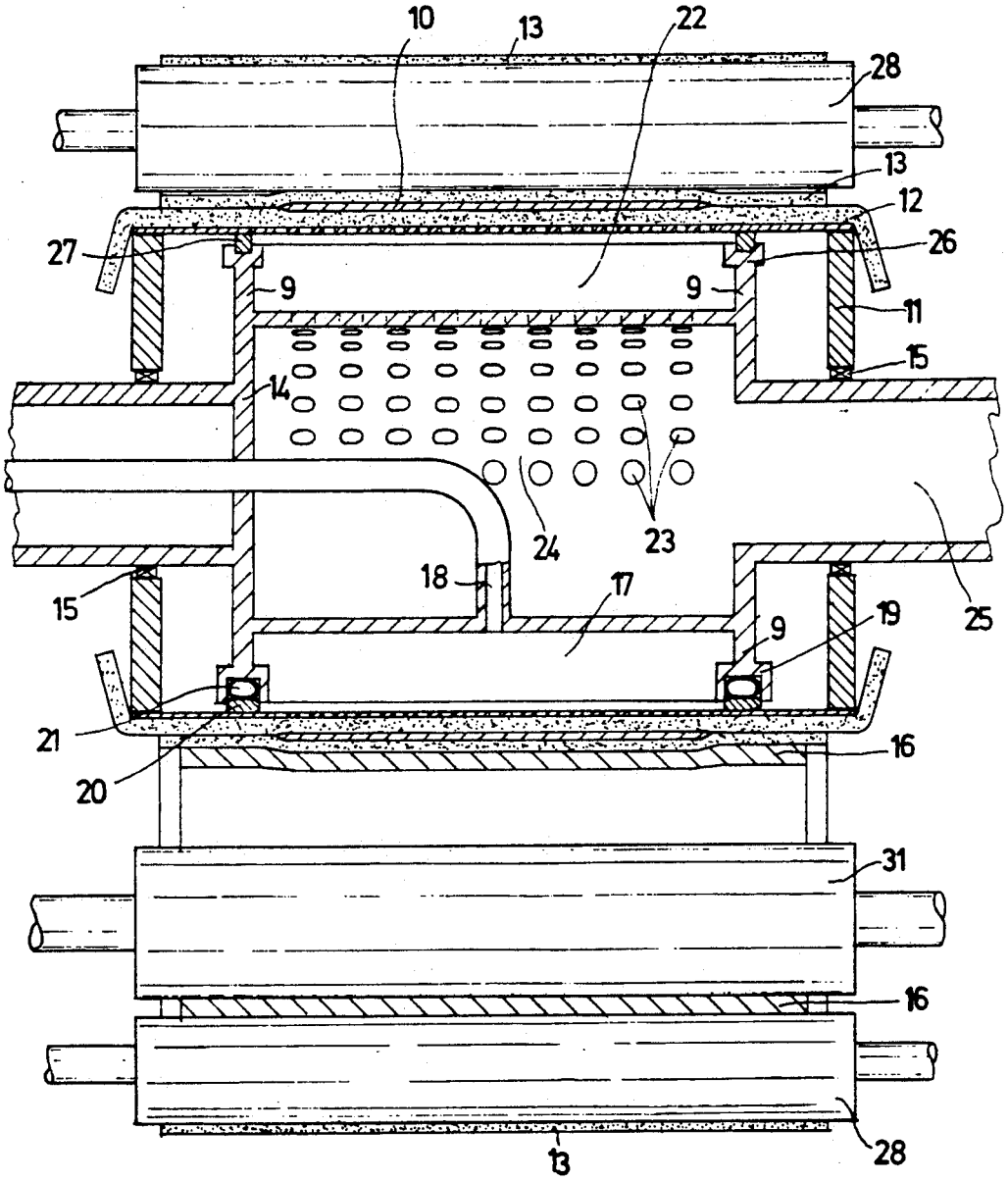
FIG. 2 is a longitudinal section through the apparatus of FIG. 1.

With reference to the FIGS. 1 and 2, the continuous fabric decatizing apparatus according to the invention includes a cylindrical drum 11 with its lateral surface (i.e., its radially outer peripheral surface) perforated and covered with a sleeve 12 of permeable textile material, about at least part of its circumference there passing a continuous fabric 10, i.e., a web of fabric having an inderminate length. Over these there passes an endless under-piece 13 also of permeable textile material, which maintains the fabric 10 in contact with the sleeve 12 at least through a part of the lateral surface of the drum 11. In the illustrated embodiment, this contact zone extends through an embracing angle of about 270°.

The drum 11, for example arranged horizontally, is rotatably supported via bearings 15 on an internal coaxial cylinder 14 fixed to a support frame (not shown). The fixed cylinder 14 has a diameter less than the cylindrical drum 11 and is kept spaced apart therefrom by radial and longitudinal wall extensions 9 positioned within at least the one part of the lateral surface of the drum 11 through which the fabric 10 is maintained in contact with the sleeve 12. In the illustrated embodiment, there are two transverse radial end wall extensions and three longitudinal radial extensions 9 coaxial to the axis of the cylinder 14, these latter connecting the former together.

An impermeable endless belt 16 which is substantially non-yieldable under tension is positioned at and maintained in contact with at least one portion of the rotary assembly comprising the drum 11, sleeve 12, fabric 10 and under-piece 13.

At the zone in which the impermeable belt 16 adheres to the under-piece 13, the inner wall of the rotary perforated cylindrical drum 11 and the outer wall of the fixed central cylinder 14 define a steaming chamber 17. The steaming chamber 17 is connected to a pipe 18 for adjustably feeding saturated steam under pressure, it passing into the fixed central cylinder 14 and being open at that end facing the inner wall of the drum 11. The steaming chamber 17 is bounded at its lateral ends by a perimetral groove 19 provided in a first group of the free ends of the transverse radial wall and longitudinal extensions 9 which are rigid with the central cylinder 14, and housing a seal element 20 such as a strip element of the scraper type, which is pressed both transversely and longitudinally against the inner wall of the cylindrical drum 11. The pressure of the strip 20 against the drum 11 is determined and regulated by an air chamber 21, such as an inflatable element, interposed between the strip 20 and the groove 19.

At at least one further portion of the rotary assembly comprising the drum 11, sleeve 12, fabric 10 and under-piece 13 following that through which the impermeable belt 16 embraces the under-piece 13, the inner wall of the rotatable perforated cylindrical drum 11 and the outer wall of the fixed central cylinder 14 define an outwardly facing suction chamber 22. The suction chamber 22 communicates via a series of holes 23 formed in a radially outer peripheral portion of the fixed cylinder 14 with an inner chamber 24 provided in the central cylinder 14. The chamber 24 is connected by a pipe 25 to a fan (not shown). The suction chamber 22 is bounded at those transverse lateral and longitudinal ends of the wall extensions 9 not adjacent to the steaming chamber 17 by a perimetral groove 26. More specifically, the groove 26 is provided in a second group of free ends of the transverse radial and longitudinal wall extensions 9 which are rigid with the central cylinder 14 and houses a seal element 27, such as a strip element of scraper type, which rests both transversely and longitudinally against the inner wall of the cylindrical drum 11.

The under-piece 13 is deviated and guided, along the part in which it does not embrace the cylindrical drum 11, by a series of deviation rollers 28, at least one of which is provided with a known pneumatic or hydraulic device (not shown) for regulating its tension, so as to be able to transmit a variable compressive pressure over that portion of the under-piece 13 embracing the cylindrical drum 11.

The impermeable belt 16 is deviated and guided through that part in which it does not embrace the under-piece 13 and cylindrical drum 11 by at least one idle deviation roller 29, a motorized drive roller 30 and a tension roller 31, also controlled and regulated by a known pneumatic or hydraulic device (not shown). In particular, in the illustrated embodiment, the drive roller 30 drives the impermeable belt 16, which then transmits movement to the under-piece 13 and consequently to the cylindrical drum 11. The tensioning roller 31 tensions the impermeable belt 16, which transmits to the under-piece 13 a variable compressive pressure over that portion in which the impermeable belt 16 embraces the under-piece 13.

The impermeable belt 16 is the element which seals outwardly against the pressure of the steam fed from the steaming chamber 17 through the assembly comprising the perforated cylindrical drum 11, the permeable sleeve 12, the fabric 10 and the permeable under-piece 13. The sealing action provided by the belt 16 derives from its impermeability and high resistance to tension, which enable it to oppose and prevent the outward escape of steam by applying a specific pressure to the under-piece 13 which is at least equal to and preferably greater than the steam pressure. In this manner, a zone is formed with an environment of saturated steam under pressure. This zone is defined internally to the perforated cylindrical drum 11 by the steaming chamber 17 with the relative lateral seal, and externally to the perforated cylindrical drum 11 by the sleeve 12 plus under-piece 13 with the relative seal. In the steaming chamber 17, the lateral seal is formed by the strip element 20 positioned perimetrally to the chamber 17 and adjustable in its action by the inflatable air chamber 21. Externally to the perforated cylindrical drum 11, the seal is provided by the impermeable belt 16 positioned externally to and in contact with the under-piece 13, and adjustable in its action by at least one tensioning roller 31 which is able to tension the belt 16 so that it transmits onto the under-piece 13 a specific pressure which is at least equal to and preferably greater than the pressure of the saturated steam fed by the pipe 18 into the chamber 17 and from here through the perforated cylindrical drum 11 to the sleeve 12, the fabric 10 and the under-piece 13.

An air suction zone is also formed directly within the apparatus, following the zone with the environment of saturated steam under pressure. This air suction zone is defined externally to the perforated cylindrical drum 11 by the permeable sleeve 12, plus under-piece 13, and internally to the perforated cylindrical drum 11 by the suction chamber 22, the internal chamber 24 of the cylindrical drum and the pipe 25. The lateral seal of the suction chamber 22 is formed by the strip elements 20 and 27 arranged perimetrally to the chamber 22. As stated, the pipe 25 is connected to a fan (not shown) which draws air from the outside environment through the under-piece 13, the fabric 10 and sleeve 12, the perforated cylindrical drum 11, the suction chamber 22, the series of holes 23, the internal chamber 24 of the central cylinder 14 and the pipe 25.

Figure 3:
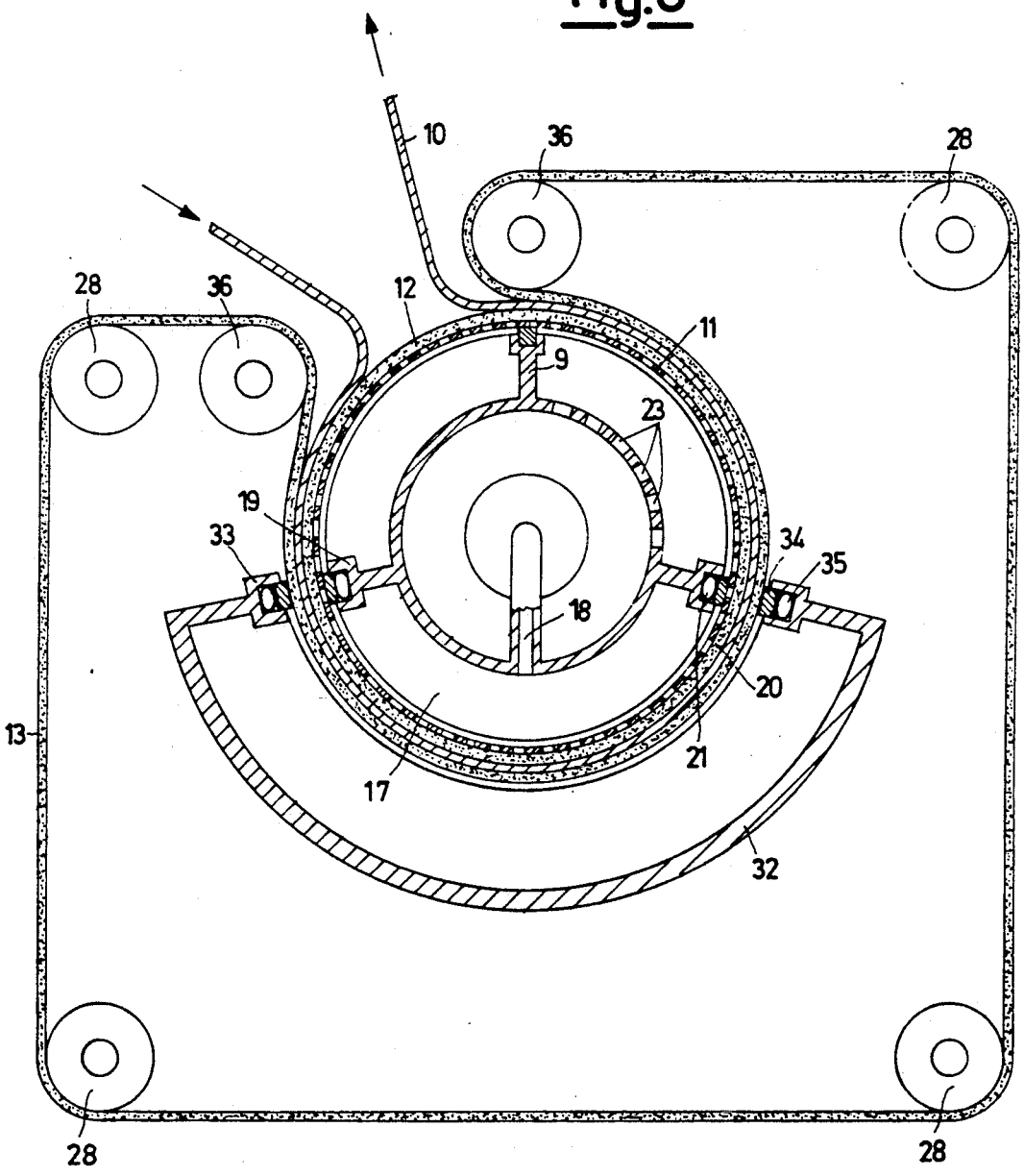
FIG. 3 is a cross-section through a further embodiment of a apparatus according to the invention.
Figure 4:
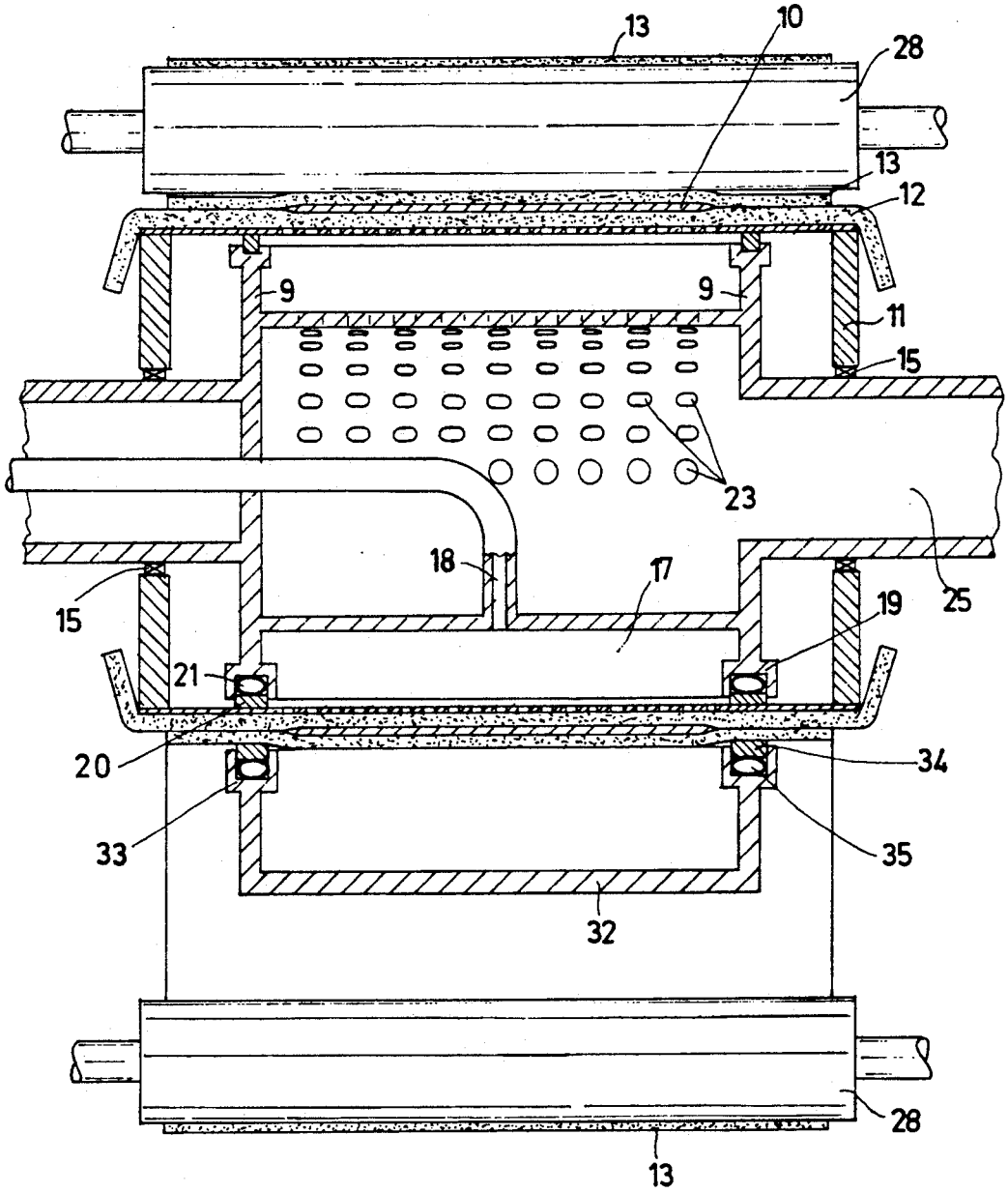
FIG. 4 is a longitudinal section through the apparatus of FIG. 3.

In a further embodiment shown in FIGS. 3 and 4, a tank 32 is provided in a position corresponding with at least one portion of the rotary assembly comprising the drum 11, the sleeve 12, the fabric 10 and the under-piece 13. The tank 32, which replaces the impermeable belt 16, is maintained in contact with the adhering assembly and is fixed laterally to the support frame (not shown), it being open at that part facing the under-piece 13.

The tank 32 comprises, at the ends of those walls radially facing the under-piece 13, a perimetral groove 33 housing a seal element 34 such as a strip element of the scraper type, which is pressed against the under-piece 13 both transversely and longitudinally with respect to the perforated cylindrical drum 11. The pressure of the strip 34 against the under-piece 13 is determined and regulated by an air chamber 35, such as an inflatable element, interposed between the strip 34 and the groove 33.

The tank 32 is positioned opposite the steaming chamber 17 so that the perimetral groove 33 and the strip 34 of the tank 32 coincide with and oppose the perimetral groove 19 and strip 20 of the chamber 17.

In this case, the steaming chamber 17 and the tank 32 define a zone with an environment of saturated steam under pressure fed from the pipe 18 into the chamber 17 and from this into the tank 32 via the assembly comprising the perforated cylindrical drum 11, the sleeve 12, the fabric 10 and the under-piece 13. In this arrangement, the under-piece 13 is deviated and guided, along the part in which it does not embrace the cylindrical drum 11, by a series of deviation rollers 28, at least one of which is provided with a known pneumatic or hydraulic device (not shown) for regulating its tension, so as to be able to transmit a variable compressive pressure over that portion of said under-piece 13 embracing the cylindrical drum 11. Two further motorized drive rollers 36 drive the under-piece 13, which transmits motion to the cylindrical drum 11.

Using an apparatus according to the present invention a method for continuous fabric decatizing is achieved in which the fabric is treated with an atmosphere of saturated steam under pressure through a portion of the treatment path along which which it is fed and maintained between a pair of layers of textile material, steam sealing members being present along the perimeter of the path portion. According to the invention, that path portion is followed by a further path portion in which the fabric, maintained between the pair of textile material layers, is subjected to forced suction.

This apparatus and the respective method hence dispense with the need for any subsequent further treatment machine or device. Specifically, the total fabric treatment is effected on a single cylindrical drum leading to a saving in plant and operation costs and simplification with respect to the known apparatus and method.

I claim:

1. Apparatus for decatizing a web of fabric of indeterminate length, comprising:

a supporting frame;

a radially inner cylinder fixed to said supporting frame, said cylinder having a longitudinal axis and a radially outer perimetral surface;

a cylindrical drum having a perforated radially outer perimetral wall which coaxially, radially spacedly surrounds said inner cylinder;

said radially outer perimetral wall of said cylindrical drum being externally provided with a circumferentially extending covering sleeve made of textile material, and about a portion of which, in use, a web of fabric of indeterminate length is to be fed for being decatized as said cylindrical drum is rotated in a given angular direction about said axis;

an endless underpiece of textile material supported so as to have a portion thereof disposed to externally embrace said radially outer perimetral wall of said cylindrical drum throughout said portion of said radially outer perimetral wall of said cylindrical drum;

said outer perimetral wall of said cylindrical drum being maintained in radially spaced relation to said inner cylinder by:

at least two transverse radially outwardly projecting walls which are secured on said inner cylinder and are axially spaced from one another along said axis;

at least three longitudinal radially outwardly projecting walls which are secured on said inner cylinder and are angularly spaced from one another about said axis;

said longitudinal walls being connected at axially opposite ends thereof to respective ones of said transverse walls, for defining between two of said transverse walls and two of said longitudinal walls a steam chamber and between two of said transverse walls and two of said longitudinal walls a forced suction treatment chamber located rotationally downstream of said steam chamber along said given angular direction; and seal elements sealing between radially inner edges of those of said walls which define said chambers and said radially outer perimetral wall of said cylindrical drum, and including a sealing structure which effectively isolates said steam chamber from said forced suction treatment chamber for preventing steam which, in use, is introduced into said steam chamber under pressure, from being lost to and suctioned-off out of said forced suction treatment chamber without having affected said web of fabric;

said cylindrical drum being supported for rotating in said direction about said axis; and sealing structure effectively providing a radially outer wall for said steam chamber externally of said portion of said endless underpiece of textile material.

2. The apparatus of claim 1, wherein:

said sealing structure comprises a respective portion of an endless, steam-impermeable belt which is maintained to run non-yieldingly in overlying contact with said portion of said endless underpiece.

3. The apparatus of claim 1, further including:

a steam inlet pipe entering said apparatus internally of said radially inner cylinder and having an outlet therefrom into said steam chamber, said outlet being directed radially outwardly through said radially outer perimetral wall thereof towards said outer perimetral wall of said cylindrical drum.

4. The apparatus of claim 1, wherein:

those of said sealing elements sealing between radially outer edges of said walls which define said steam chamber and said radially outer perimetral wall of said cylindrical drum, and including said sealing structure, include radially outwardly opening grooves provided in respective radially outer edges of respective ones of said walls, and a seal structure received in said grooves and pressing against a radially inner surface of said outer perimetral wall of said cylindrical drum.

5. The apparatus of claim 4, wherein:

said seal structure comprises a sealing strip which, in use, is disposed in scraping contact with said radially inner surface of said outer perimetral wall of said cylindrical drum.

6. The apparatus of claim 5, wherein:

said seal structure further comprises an inflated air chamber disposed in said grooves radially inwardly of said sealing strip, said inflated air chamber pressing said sealing strip against said radially inner surface of said outer perimetral wall of said cylindrical drum.

7. The apparatus of claim 1, wherein:

those of said sealing elements sealing between radially outer edges of said walls which define said force suction treatment chamber and said radially outer perimetral wall of said cylindrical drum, except for said sealing structure, include radially outwardly opening grooves provided in respective radially outer edges of respective ones of said walls, and a seal structure received in said grooves and resting against a radially inner surface at said outer perimetrical wall of cylindrical drum.

8. The apparatus of claim 7, wherein:

said seal structure comprises a sealing strip which, in use, is disposed in scraping contact with said radially inner surface of said outer perimetral wall of said cylindrical drum.

9. The apparatus of claim 1, wherein:

said sealing structure comprises a radially inwardly open tank which is radially outwardly closed as well as being closed at axially and angularly opposite ends thereof, said tank having a radially inner perimetral edge, and a seal structure sealing between said edge and a radially outer surface of said endless underpiece of textile material.

10. The apparatus of claim 9, wherein:

said seal structure sealing between said edge and said radially outer surface of said endless underpiece of textile material comprises a perimetral groove formed in said edge and a seal received in said perimetral groove and pressing against said radially outer surface of said endless underpiece of textile material.

11. The apparatus of claim 10, wherein:

said seal comprises a sealing strip which, in use, is disposed in scraping contact with said radially outer surface of said endless underpiece of textile material.

12. The apparatus of claim 11, wherein:

said seal structure further comprises an inflated air chamber disposed in said groove radially outwardly of said sealing strip, said inflated air chamber pressing said sealing strip against said radially outer surface of said endless underpiece of textile material.

* * * * *